US010040165B2

(12) United States Patent
Seeley et al.

(10) Patent No.: US 10,040,165 B2
(45) Date of Patent: Aug. 7, 2018

(54) MASS FINISHING COMPONENT ENCLOSURE DEVICE AND SYSTEM

(71) Applicant: On-X Life Technologies, Inc., Austin, TX (US)

(72) Inventors: Cole Seeley, Austin, TX (US); Mark E. Seeley, Austin, TX (US)

(73) Assignee: On-X Life Technologies, Inc., Austin, TX (US)

( * ) Notice: Subject to any disclaimer, the term of this patent is extended or adjusted under 35 U.S.C. 154(b) by 607 days.

(21) Appl. No.: 14/396,553

(22) PCT Filed: Apr. 25, 2013

(86) PCT No.: PCT/US2013/038134
§ 371 (c)(1),
(2) Date: Oct. 23, 2014

(87) PCT Pub. No.: WO2013/163376
PCT Pub. Date: Oct. 31, 2013

(65) Prior Publication Data

US 2015/0151399 A1 Jun. 4, 2015

Related U.S. Application Data

(60) Provisional application No. 61/638,133, filed on Apr. 25, 2012.

(51) Int. Cl.

| | |
|---|---|
| ***B24B 31/02*** | (2006.01) |
| ***B24B 31/00*** | (2006.01) |
| ***B24B 31/12*** | (2006.01) |
| ***B24B 31/06*** | (2006.01) |

(52) U.S. Cl.
CPC ..... *B24B 31/0224* (2013.01); *B24B 31/064* (2013.01); *B24B 31/12* (2013.01)

(58) Field of Classification Search
CPC .... B24B 31/0224; B24B 31/064; B24B 31/12
USPC ..... 451/32; 220/4.01, 4.24, 4.25, 9.4, 507
See application file for complete search history.

(56) References Cited

U.S. PATENT DOCUMENTS

| | | | | | |
|---|---|---|---|---|---|
| 1,665,065 | A | * | 4/1928 | Malloy | B04B 5/02 210/325 |
| 3,552,548 | A | * | 1/1971 | Wallestad | B65D 25/10 206/509 |
| 3,990,579 | A | * | 11/1976 | Manning | A45C 11/005 134/137 |
| 4,838,413 | A | * | 6/1989 | Monestere | A45C 11/005 134/137 |
| 4,889,693 | A | * | 12/1989 | Su | A61L 12/128 134/901 |

(Continued)

OTHER PUBLICATIONS

Kramer Industries, "FAQ for Tumbling and Abrasive Blasting Surface Finishing Processes," http://www.kramerindustriesonline.com/finishing-guides/faq.htm, 4 pages.

(Continued)

*Primary Examiner* — Joseph J Hail
*Assistant Examiner* — J Stephen Taylor
(74) *Attorney, Agent, or Firm* — Trop, Pruner & Hu, P.C.

(57) ABSTRACT

An embodiment comprises a container to include a substrate during processing (e.g., centrifugal or vibratory processing) and protect the substrate from other substrates (e.g., medical implants) that are simultaneously being processed and/or from the polishing environment (e.g. vibratory tub sidewalls) during processing. Other embodiments are described herein.

19 Claims, 5 Drawing Sheets

(56) References Cited

U.S. PATENT DOCUMENTS

| | | | | |
|---|---|---|---|---|
| 4,890,729 | A * | 1/1990 | Ranalletta | A45C 11/005 134/901 |
| 4,956,156 | A * | 9/1990 | Kanner | A45C 11/005 206/438 |
| 5,114,686 | A * | 5/1992 | Gillespie | A61L 12/128 206/438 |
| 5,355,638 | A * | 10/1994 | Hoffman | B24B 31/0212 451/32 |
| 7,350,679 | B2 * | 4/2008 | Radtke | A47G 25/20 223/1 |
| 8,109,417 | B2 * | 2/2012 | Phan | D06F 95/006 223/84 |
| 9,260,816 | B2 * | 2/2016 | Lander | D06F 95/008 |

OTHER PUBLICATIONS

Kramer Industries, "Understanding the Basics of Barrel Tumbling Detailed Finishing Guide," http://www.kramerindustriesonline.com/finishing-guides/barrel-finishing-guide.htm, 6 pages.

depuy.com, "Pinnacle Bantam Acetabular Cup System (38mm-46mm)," http://www.depuysynthes.com/healthcare-professionals/product-details/pinnacle-bantam-acetabula, 1 page.

Zimmer, Inc., "ZCA All-Poly Acetabular Cup," Product Brochure and Ordering Information, Rev. 3, 2008, USA, 4 pages.

Kramer Industries, "Deburring & Surface Finishing, A Guide to Choosing the Right System," http://www.kramerindustriesonline.com/finishing-guides/choosing-the-right-system.htm, 4 pages.

Elsevier Masson SAS, "Total hip revision using a cup design with a peg to treat severe pelvic bone defects," http://www.em-consulte.com/en/article/708750, 2012, 8 pages.

Zimmer, Inc., "Trabecular Metal Humeral Stem Surgical Technique," Product Brochure and Surgical Guide, Rev. 1, 2010, USA, 20 pages.

Patent Cooperation Treaty, "International Preliminary Report on Patentability and Written Opinion," in International Application No. PCT/US2013/038134 filed Apr. 25, 2013, 4 pages.

* cited by examiner

MASS FINISHING COMPONENT ENCLOSURE DEVICE AND SYSTEM

This application is a § 371 National Stage Entry of International Application No. PCT/US2013/038134, filed Apr. 25, 2013 and entitled "Mass Finishing Component Enclosure Device and System", which claims priority to U.S. Provisional Patent Application No. 61/638,133 filed on Apr. 25, 2012 and entitled "Mass Finishing Component Enclosure Device and System". The content of each of the above applications is hereby incorporated by reference.

TECHNICAL FIELD

An embodiment of the invention concerns manufacturing technologies and, more specifically, polishing technologies.

BACKGROUND

In mass finishing processes components (e.g., articles of manufacture) may be included in an enclosure (e.g., barrel, bin, tub) along with polishing media (e.g., pumice, wood pegs, walnut shell grit, corn cob grit, aluminum oxide, ceramic media, plastic media, steel balls), a carrying agent, an abrasive compound, and/or a polishing cream. Any of the above media, agents, compounds, and creams (and combinations thereof) may be used in a dry process or used in a liquid slurry. The components within the enclosure may then be polished together as a group using, for example, vibration, centrifugal motion, and the like.

DETAILED DESCRIPTION

Figure 1:
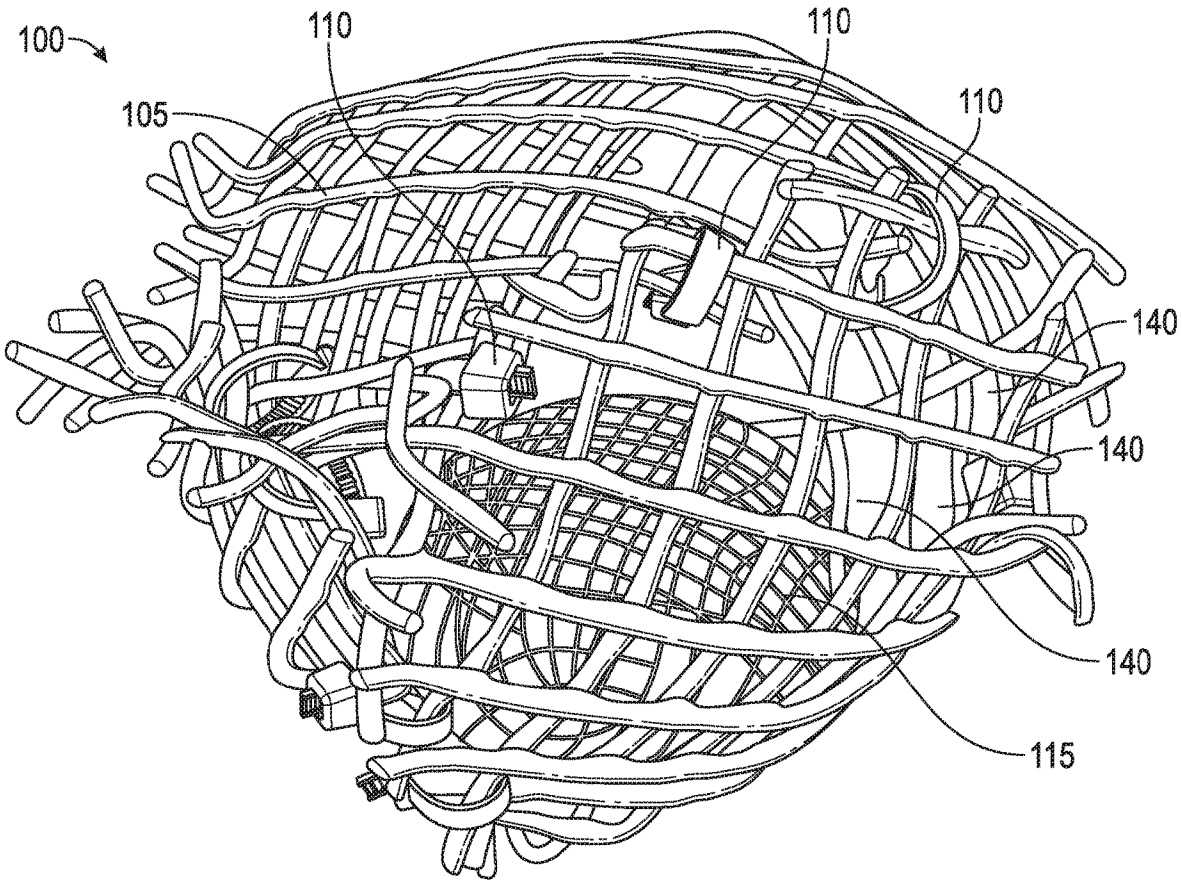
FIG. 1 depicts mesh container in an embodiment of the invention.

In the following description, numerous specific details are set forth but embodiments of the invention may be practiced without these specific details. Well-known structures and techniques have not been shown in detail to avoid obscuring an understanding of this description. "An embodiment", "various embodiments" and the like indicate embodiment(s) so described may include particular features, structures, or characteristics, but not every embodiment necessarily includes the particular features, structures, or characteristics. Some embodiments may have some, all, or none of the features described for other embodiments. "First", "second", "third" and the like describe a common object and indicate different instances of like objects are being referred to. Such adjectives do not imply objects so described must be in a given sequence, either temporally, spatially, in ranking, or in any other manner. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same embodiment.

As addressed above, multiple components within an enclosure (e.g., barrel, bin) may be polished together as a group. However, problems may occur when the components (e.g., sometimes referred to as a "substrate" such as a shoulder or hip or heart implant) get too large and collide with other components that are being polished within the enclosure. These problems can include fracture, chipping, and/or degradation in polish of the components. While these problems occur when simultaneously polished components contact one another, the problem (or some degree thereof) may still occur for a component polished by itself as the component may still collide with elements of the polish bin (e.g., the walls of the bin and/or shelves included on the walls of the bin for manipulating/elevating polishing media).

An embodiment protects fragile components as they are polished via "mass finishing" methodologies (e.g., vibratory, barrel, and/or centrifugal polishing). The embodiment includes an enclosure for mass finishing components that are prone to damage as a result of collision with either each other and/or the environment (walls of the barrel or bin, projections from the wall of the barrel or bin) in which they are being polished (e.g., components that are brittle). Such components include, for example, ceramic medical device components (e.g., acetabular cup of a shoulder or hip implant, a stem of a shoulder or hip implant), pyrolytic carbon coated or treated medical device implants, and the like. The embodiment allows a user to polish large components (alone or simultaneously with other same or similar components) that are prone to damage during collisions. The embodiment reduces in-process scrap rates associated with mass finishing large components (e.g., orthopedic medical device components).

An embodiment includes a polish cage design for a centrifugal mass finishing machine, although embodiments are not limited to implementation with any one specific type of finishing machine. Such varied finishing machines include tumbling equipment (rotates loads to cascade downhill), vibratory equipment (vibrations cause a scrubbing action of media against parts), centrifugal equipment (action same as a barrel tumbler but augmented by centrifugal force), tumbling blasting equipment (parts are tumbled slowly to provide random exposure to a sandblasting gun using an abrasive), and the like.

An embodiment comprises a container to include a medical implant during processing (e.g., finishing pyrolytic carbon coating on the implant in a centrifugal machine) and protect the implant from other implants that are simultaneously being processed and/or from the polishing environment (e.g. vibratory tub) during processing.

Conventionally products are finished with 1 part in 1 tub. A processing machine may process 1 or more tubs simultaneously. If a lot includes 5 parts then a user needs to use 5 tubs for 1 lot of parts. Such a user can process only one lot per cycle (assuming the machine processes 5 tubs per cycle). One embodiment includes increasing the number of lots processed while decreasing the total number of runs by running, for example, all five parts in a single tub, bin, barrel, or the like. Multiple tubs (e.g., containers) can be simultaneously run in a single process so multiple lots can be run in a single process iteration (e.g., for a 5 tub machine 5 lots may be run per cycle or iteration). To allow for five parts per tub (or 2, 3, 4, 6, 7, 8 or more parts per tub in other embodiments) a tub may be compartmentalized by stacking, for example, 4 polycarbonate polymer discs on a nylon rod that runs the length of the tube (thereby creating 5 separate compartments, each to include a part). The polycarbonate polymer discs may have several holes/windows (fenestrations) formed (e.g., drilled or molded) in them to allow polishing media to flow through them so the parts are all processed equally. The disks may be fixed with holes small enough to prevent parts from moving from one compartment to another (where they may collide and suffer damage) but allow polishing media to flow through the holes.

An embodiment includes an individual cage such as a 150 ml plastic beaker-like container (e.g., 150 ml cylindrical container) with several ½" fenestrations included therein for media flow, along with a lid made of nylon mesh (e.g., netting) secured to the beaker (e.g., with various fasteners such as tie wraps). Multiple beaker-like containers may be used such as, for example, 3 containers respectively including 3 parts that are processed simultaneously in the same bin (such that the beaker-like containers may contact each other but the components inside those beakers do not contact each other). This allows for greater throughput during, for example, centrifugal grind and polish cycles. The beaker-like containers (which may have various shapes such as tubular, spheroid, rectangular) may be constructed of a resilient material, a plastic, and the like to absorb collision energy and not fully transfer the collision energy to the parts (and also not have the container break apart).

FIG. 1 depicts mesh container 100 in an embodiment of the invention. Mesh 105, comprising nylon for example, is closed upon itself using one or more fasteners 110 (e.g., tie wraps) to secure component 115 therein. Mesh 105 includes many fenestrations 140 (some of which, but not all, are labeled).

Figure 2:
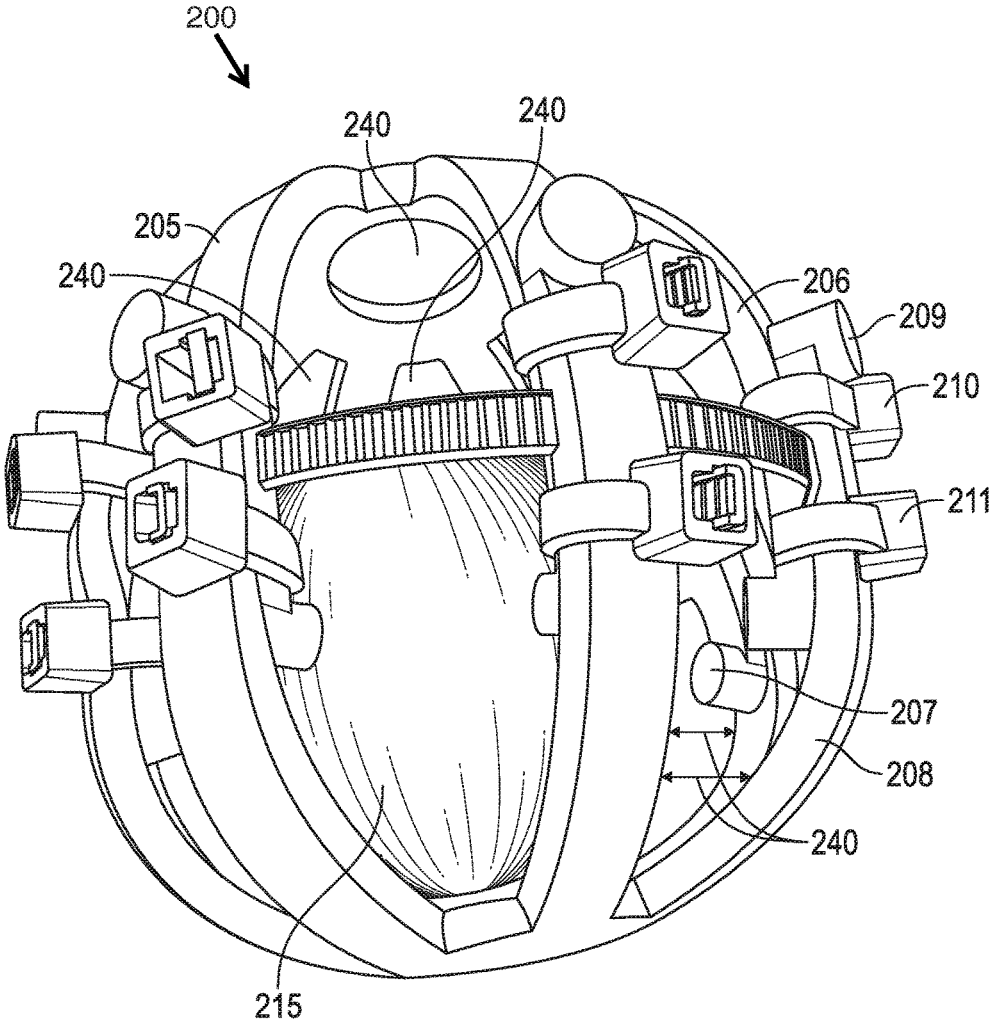
FIG. 2 depicts coupled "spider bands" in an embodiment of the invention.

FIG. 2 depicts container 200 with "spider bands" in an embodiment of the invention. A spider band, as that term is used herein, concerns a pliable (i.e., flexible, relatively soft) multi-armed restraining apparatus (including 3, 4, 5, 6, 7, 8, 9, 10 or more arms or appendages). In FIG. 2 arm 205 is labeled but not all arms are labeled. Arm 206 includes a nodular end portion 207 and arm 208 includes a nodular end portion 209 (but other embodiments are not so limited). In an embodiment opposing arms (e.g., arms 206, 208) are fastened together (e.g., using tie wraps 210, 211). Other fasteners (e.g., 212) are possible as well to decrease fenestration size. Arms couple together to form fenestrations 240 (some of which, but not all, are labeled). Thus, the embodiment of FIG. 2 includes elastic members such as, for example, spider bands that are coupled (e.g., tie wrapped) to one another forming a ball that part 215 fits inside.

Figure 3:
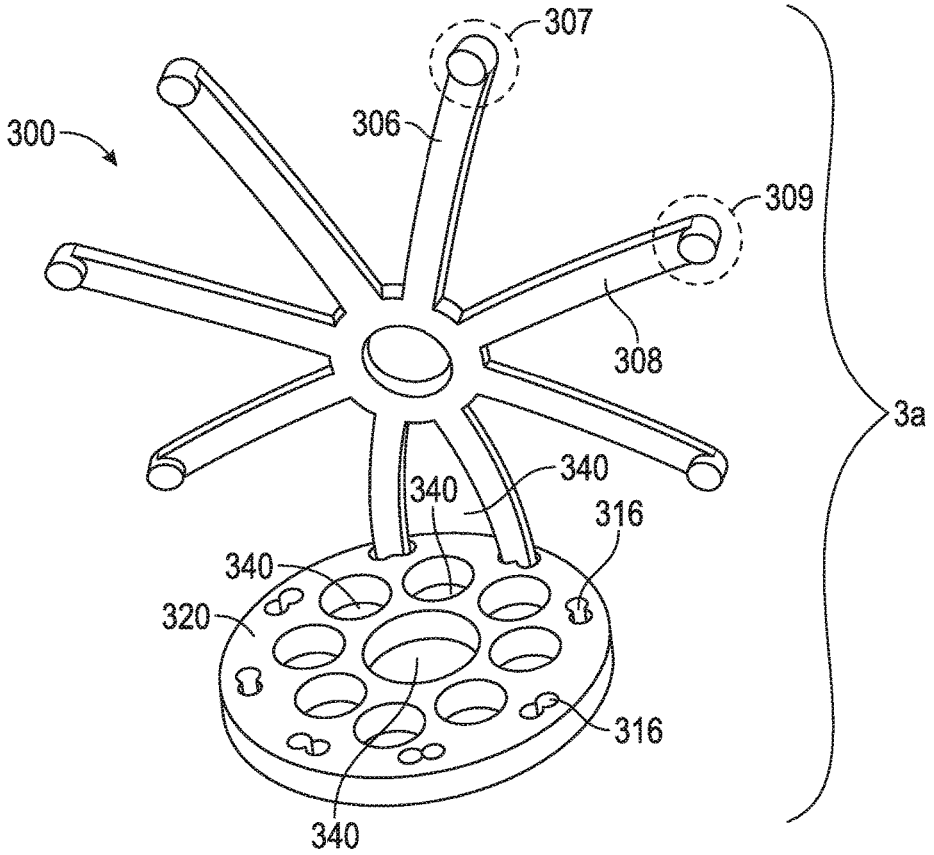
FIGS. 3*a* and 3*b* depict a cap coupled to a base in an "open" configuration (3*a*) and a "closed" configuration (3*b*) in an embodiment of the invention.
Figure 3:
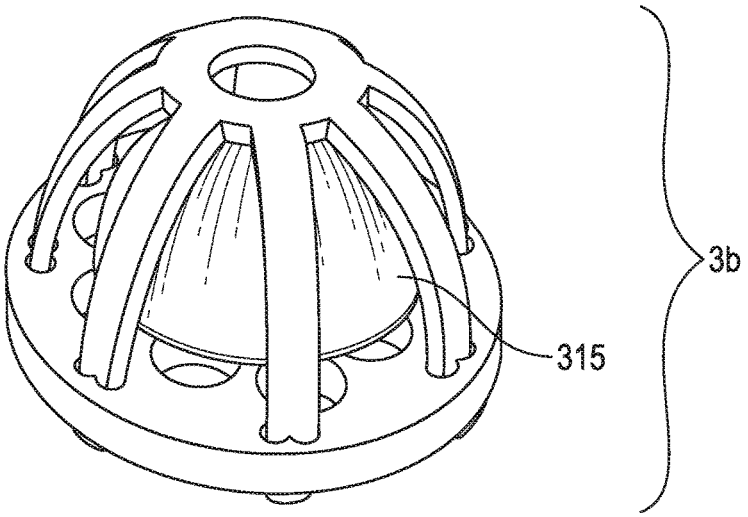

FIGS. 3*a* and 3*b* depict container 300 including a cap coupled to a base in an "open" configuration (3*a*) and a "closed" configuration (3*b*) in an embodiment of the invention. The embodiment includes base 320 (e.g., urethane disc), with holes 316 for the legs of the spider bands to pass through and to be secured in place by friction alone (although adhesives and other coupling mechanisms may be used in other embodiments). Base 320 may include a large hole in the center for part 315 to pass through but other embodiments are not so limited. Arms 306, 308 include nodular portions 307, 309 that pass through holes (e.g., holes 316) to couple base 320 to the cap that comprises the arms. In an embodiment arms couple to base 320 and each other to form fenestrations 340 (some of which, but not all, are labeled and which are in addition to or in lieu of fenestrations in the base itself).

Figure 4:
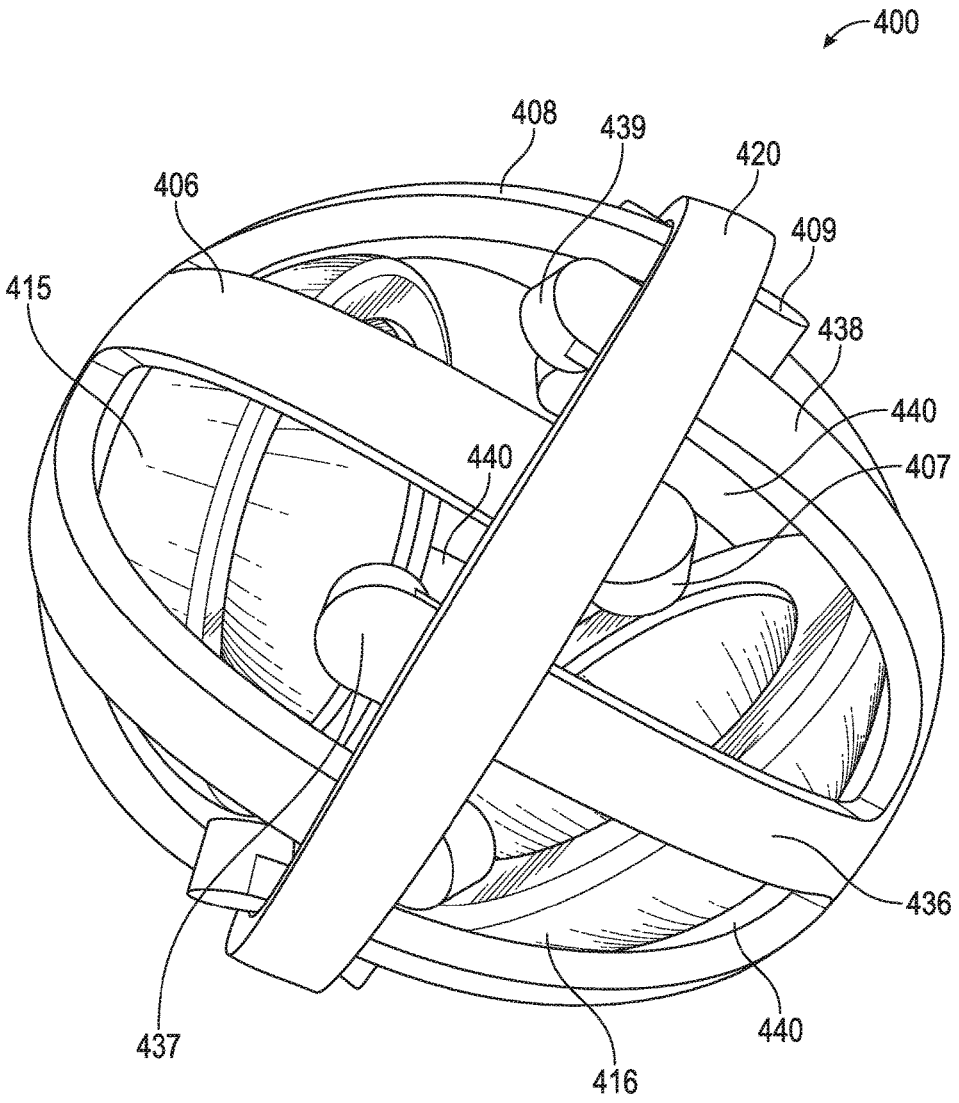
FIG. 4 depicts two caps coupled to a base in a "closed" configuration in an embodiment of the invention.

FIG. 4 depicts container 400 with two caps coupled to a base in a "closed" configuration in an embodiment of the invention. Base 420 is similar to base 320 (FIG. 3) and include holes through which nodular portions 409, 439, 407, 437 (among others) mate arms 408, 438, 406, 436 to base 420, thereby forming fenestrations 440 (some of which, but not all, are labeled). Using two caps (one cap including arms 406, 408 and another cap including arms 436, 438) provides two substrates 415, 416 for one container.

Figure 5:
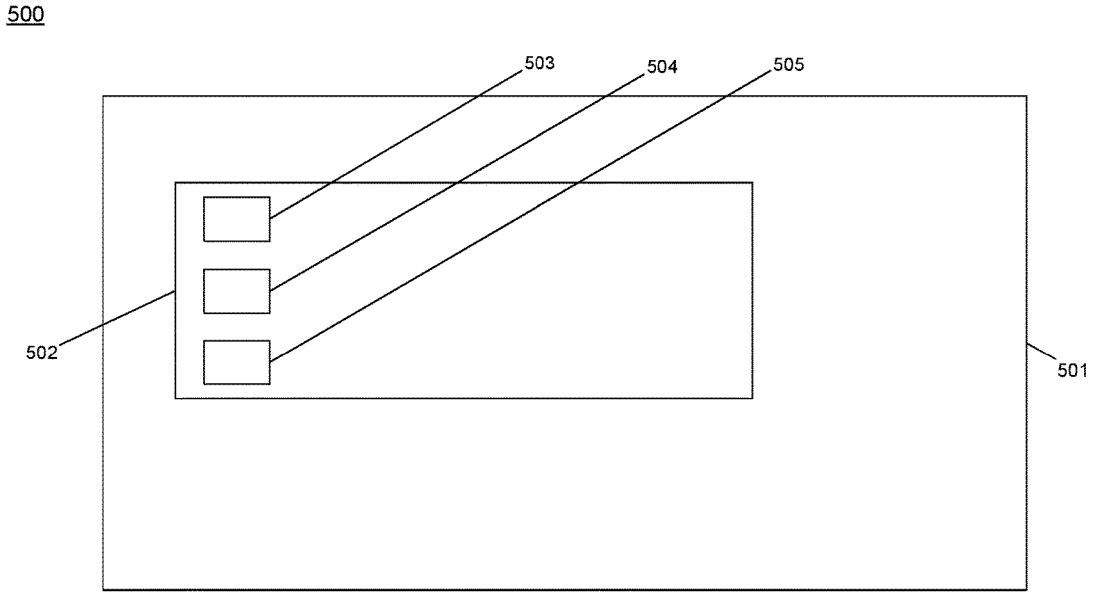
FIG. 5 depicts an embodiment of a system 500 comprising a polisher 501 that includes a bin 502. The bin includes containers 503, 504, 505.

FIG. 5 depicts system 500, which comprises a polisher 501 that includes a bin 502. The bin includes containers 503, 504, 505.

Various embodiments provide varying numbers of holes for spider legs (e.g., 2, 4, 6, 8, 10) and several holes (e.g., 0.25, 0.5, 0.75, 1.0 inches) for media to pass through during the processing.

Embodiments provide individually polishing components in separate mass finishing enclosures as well as group or mass finishing components. Embodiments protect devices that are being finished in either scenario.

An embodiment includes an assemblage for polishing at least one substrate simultaneously with at least one additional substrate while preventing the at least one substrate from directly contacting the at least one additional substrate comprising: a container to confine the at least one substrate; wherein: the container includes a base and a cap and the cap is keyed to couple to the base; each of the base and the cap comprise at least one of rubber, neoprene, urethane, PVC, vinyl, and a pliable polymer; each of the base and the cap comprise a plurality of fenestrations configured to (a) freely allow polishing media to flow through the plurality of fenestrations and contact the at least one substrate, yet (b) generally prevent the at least one additional substrate from directly contacting the at least one substrate confined in the container while the at least one substrate and the additional at least one substrate are simultaneously subjected to a polishing stream of the polishing media; and the base and cap are configured to loosely contain the at least one substrate so the at least one substrate is not in constant contact with any portion of the container during polishing. The base and the cap may be more generally conceived of as a first portion and a second portion that couple directly or indirectly to one another. The may be keyed such as FIG. 3 where a hole in the base is configured to receive an element (e.g., arm) from the cap. The base and/or the cap may comprise rubber, neoprene, urethane, PVC, vinyl, and a pliable polymer and mixtures thereof. Because the base and cap are configured to loosely contain the at least one substrate so the at least one substrate is not in constant contact with any portion of the container during polishing there will be no portion that is shielded from polishing because it is pressed tightly against a portion of the container (and therefore not accessible to polishing media). The polishing stream should not be interpreted to only concern a slurry and may further include dry processing with a stream of, for example, pumice and the like.

An embodiment includes wherein at least a portion of the plurality of fenestrations for at least one of the cap and the base are defined by a plurality of arms that terminate at a central location of the at least one of the cap and the base. For example, in FIG. 3 several arms terminate at a central circle of the cap.

An embodiment includes wherein the base is generally flat and the cap is concave when coupled to the base. An embodiment includes an additional cap to couple to the base so the base and the cap are configured to loosely contain the at least one substrate and the base and the additional cap are configured to simultaneously loosely contain another substrate. While the above addresses a 2 substrate embodiment it also addresses other embodiments that may have sub-chambers to accommodate more substrates.

An embodiment includes wherein the container is sized to completely contain a substrate greater than 35 mm in maximum diameter. This may accommodate, for example, an acetablular cup having a maximum diameter of 38, 40, 42, 43, 46, 61 mm or more. An embodiment includes wherein the substrate is a medical device. An embodiment includes wherein the container is sized to completely contain a substrate greater than 45 mm in maximum diameter. This may accommodate, for example, a femoral or humeral stem having a maximum length of 50 mm or more. An embodiment includes wherein the container is sized to completely contain a substrate having a maximum length greater than 100 mm. This may accommodate, for example, a femoral or humeral stem having a maximum length of 130, 170 mm or more. An embodiment includes at least one of a centrifugal polisher and a vibratory polisher. The dimensions above are critical and not arbitrary in that they concern a problem where larger substrates, when polished alone or with one another, are more susceptible to dings and otherwise less than ideal polishing. For example, polishing larger orthopedic devices (acetabular cups, humeral and femoral stems, and the like) are problematic and greatly improved using various embodiments described herein.

Load heights (substrates and media) may be between 45% and 60% of tub capacity. An embodiment includes a load height between 45-55% with approximately 3 parts media to 1 part substrate. With conventional systems the ratio may need to be 6:1 for large parts that are, for example, greater than 35 mm in maximum diameter. Other embodiments operate with 4:1 or 5:1 ratios. As the load height increases, the action is slowed. Raising the load height may be used to soften the action. However this ratio adjustment from about 3:1 may not be necessary with embodiments of the invention.

An embodiment includes a method of polishing multiple substrates comprising: containing a first substrate in a first container and a second substrate in a second container; and simultaneously polishing the first and second contained substrates in polishing media while preventing the first and second contained substrates from directly contacting each other; wherein: the first and second containers each include a base coupled to a cap; each of the first and second container's bases and caps comprise a plurality of fenestrations configured to (a) freely allow the polishing media to flow through the plurality of fenestrations and contact the first and second substrates, yet (b) generally prevent the first and second substrates from directly contacting each other during the simultaneous polishing; each of the first and second container's bases and caps are configured to loosely contain the first and second substrates so the first and second substrates are not in constant contact with any portion of the first and second containers during polishing. An embodiment includes wherein the first container comprises an additional cap to couple to the base so the base and cap of the first container are configured to loosely contain the first substrate and the base and additional cap of the first container are configured to simultaneously and loosely contain another substrate. An embodiment includes wherein the first container is sized to completely contain that first substrate which is greater than 35 mm in maximum diameter. An embodiment includes simultaneously polishing the first and second contained substrates in the polishing media using at least one of a centrifugal polisher and a vibratory polisher. An embodiment includes simultaneously wet polishing the first and second contained substrates in the polishing media. An embodiment includes simultaneously dry polishing the first and second contained substrates in the polishing media.

An embodiment includes an assemblage for polishing at least one substrate comprising: a container to confine at least one substrate; wherein: the container includes a base to releasably couple to a cap; each of the base and the cap comprise a plurality of fenestrations configured to (a) freely allow polishing media to flow through the plurality of fenestrations and contact the at least one substrate, yet (b) generally prevent an additional substrate from directly contacting the at least one substrate confined in the container while the at least one substrate and the additional substrate are simultaneously subjected to a polishing stream of polishing media; and the base and cap are configured to loosely contain the at least one substrate so the at least one substrate is not in constant contact with any portion of the container during polishing. An embodiment includes wherein the base is generally flat and the cap is concave when coupled to the base. An embodiment includes an additional cap to couple to the base so the base and cap are configured to loosely contain the at least one substrate and the base and the additional cap are configured to simultaneously loosely contain another substrate. An embodiment includes wherein the container is sized to completely contain a substrate greater than 35 mm in maximum diameter. In an embodiment container is sized to completely contain a substrate greater than 35 mm in maximum diameter while included in a bin with a load height between 45% and 60% of bin capacity approximately 3 parts media to 1 part substrate. In an embodiment the container is sized to completely contain a substrate greater than 35 mm in maximum diameter while the substrate is included in a bin including (a) a load height of substrates and polishing media between 45% and 60% of bin capacity, and (b) a ratio less than 4 parts media to 1 part substrate.

Use of embodiments addressed herein allow a user to process larger substrates (possibly simultaneously with one another) without having to slow tumble rates or add/decrease polish media to lessen the impact of the substrate on polishing machinery and/or other substrates.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A system to polish at least one substrate comprising:

a first container to confine a first substrate;

wherein:

the first container includes a first base to releasably couple to a first cap;

each of the first base and the first cap comprise first fenestrations configured to (a) freely allow polishing media to flow through the first fenestrations and contact the first substrate, yet (b) generally prevent a second substrate from directly contacting the first substrate confined in the first container while the first substrate and the second substrate are simultaneously subjected to a polishing stream of polishing media;

the first base and the first cap are configured to loosely contain the first substrate so the first substrate is not in constant contact with any portion of the first container during polishing;

the first substrate includes at least one of a ceramic, a pyrolytic carbon coating, a shoulder implant, a hip implant, and a heart implant;

the first base includes at least one of a polycarbonate, rubber, urethane, vinyl, and combinations thereof;

the first cap includes at least one of a polycarbonate, rubber, urethane, vinyl, and combinations thereof;

the first cap includes first and second arms;

the first base includes first and second voids;

in a first orientation an end portion of the first arm is located within the first void to contain the first substrate within the first container;

in a second orientation the end portion of the first arm is not located within the first void and the first arm does not contain the first substrate within the first container;

in the first orientation the first arm is bent with a first radius of curvature;

in the second orientation the second arm is not bent with the first radius of curvature.

2. The system of claim 1 wherein the first base is generally flat and the first cap is concave when the first cap is in the first orientation.

3. The system of claim 1 wherein the first container is sized to completely contain the first substrate, which is greater than 35 mm in maximum diameter, while the first substrate is included in a bin and the bin includes (a) a load height of substrates and polishing media between 45% and 60% of bin capacity, and (b) a ratio less than 4 parts media to 1 part substrate.

4. The system of claim 1 comprising:

a second container to confine the second substrate;

a third container to confine a third substrate;

a bin proportioned to include the first, second, and third containers;

wherein:

the second container includes a second base to releasably couple to a second polymer cap;

each of the second base and the second cap comprise second fenestrations configured to (a) freely allow polishing media to flow through the second fenestrations and contact the second substrate, yet (b) generally prevent the first substrate from directly contacting the second substrate confined in the second container while the second substrate and the first substrate are simultaneously subjected to a polishing stream of polishing media; and the second base and second cap are configured to loosely contain the second substrate so the second substrate is not in constant contact with any portion of the second container during polishing;

wherein:

the third container includes a third base to releasably couple to a third cap;

each of the third base and the third cap comprise third fenestrations configured to (a) freely allow polishing media to flow through the third fenestrations and contact the third substrate, yet (b) generally prevent the first substrate from directly contacting the third substrate confined in the third container while the third substrate and the first substrate are simultaneously subjected to a polishing stream of polishing media; and the third base and third cap are configured to loosely contain the third substrate so the third substrate is not in constant contact with any portion of the third container during polishing.

5. The system of claim 4 comprising the first, second, and third substrates.

6. The system of claim 5 comprising a centrifugal polisher to operate with the bin.

7. The system of claim 1, wherein:

the first arm is resilient;

in the second orientation the first arm is relaxed;

in the first orientation the first arm is unrelaxed, stressed, and bent.

8. The system of claim 7, wherein in response to the first arm being resilient, when the end portion of the first arm is removed from the first void of the base the first arm resiliently returns to the second orientation.

9. A system comprising:

a container configured to confine a substrate during mass finishing of the substrate;

wherein:

the container includes a base and a cap;

the base includes fenestrations and the cap includes additional fenestrations;

the cap includes first and second arms and the base includes first and second voids;

in a first orientation a portion of the first arm is located within the first void to: (a)(i) releasably couple the first arm to the base, and (a)(ii) contain the substrate within the container;

in a second orientation the portion of the first arm is not located within the first void and the first arm does not contain the substrate within the container;

in the first orientation the first arm is bent with a radius of curvature;

in the second orientation the first arm is not bent with the radius of curvature; and in the first orientation the first arm is configured to periodically directly contact the substrate during mass finishing of the substrate.

10. The system of claim 9 wherein:

in the first orientation a portion of the second arm is located within the second void to: (a)(i) couple the second arm to the base, and (a)(ii) contain the substrate within the container;

in the second orientation the portion of the second arm is not located within the second void and the second arm does not contain the substrate within the container;

in the first orientation the second arm is substantially bent with the radius of curvature; and in the second orientation the second arm is not bent with the radius of curvature.

11. The system of claim 9 comprising the substrate and an additional cap, wherein;

the mass finishing includes at least one of centrifugal polishing and vibratory polishing;

the substrate is greater than 35 mm in maximum diameter; and the substrate includes at least one of an orthopedic implant and a heart implant.

12. The system of claim 9 wherein the cap includes at least one of a polycarbonate, a rubber, a urethane, a vinyl, and combinations thereof.

13. The system of claim 12 wherein the base includes at least one of a polycarbonate, a rubber, a urethane, a vinyl, and combinations thereof.

14. The system of claim 9, wherein:

the first arm is resilient;

in the second orientation the first arm is relaxed;

in the first orientation the first arm is unrelaxed, stressed, and bent.

15. The system of claim 9 wherein during transition from the first orientation to the second orientation the first arm resiliently returns to the second orientation.

16. The system of claim 9, wherein in the second orientation the first arm is not substantially bent.

17. The system of claim 9 wherein the container is greater than 35 mm in maximum diameter.

18. The system of claim 9 comprising the substrate, wherein:

the first arm includes an outer surface and the substrate includes an outer surface;

the outer surface of the substrate is harder than the outer surface of the first arm.

19. A method of polishing multiple substrates comprising:

containing a first substrate in a first container and a second substrate in a second container; and simultaneously mass finishing the first and second contained substrates in polishing media while preventing the first and second contained substrates from directly contacting each other;

wherein:

the first container includes a base coupled to a cap;

the base includes fenestrations and the cap includes additional fenestrations;

the cap includes first and second arms and the base includes first and second voids;

in a first orientation a portion of the first arm is located within the first void to: (a)(i) releasably couple the first arm to the base, and (a)(ii) contain the first substrate within the container;

in a second orientation the portion of the first arm is not located within the first void and the first arm does not contain the first substrate within the container;

in the first orientation the first arm is bent with a radius of curvature;

in the second orientation the first arm is not bent with the radius of curvature; and in the first orientation the first arm is configured to periodically directly contact the first substrate during mass finishing of the first substrate.

* * * * *